US012655583B2

(12) United States Patent
Aho et al.

(10) Patent No.: US 12,655,583 B2
(45) Date of Patent: Jun. 16, 2026

(54) METHOD FOR TREATING TEXTILE FIBERS OF DIFFERENT LENGTHS

(71) Applicant: Valmet Technologies Oy, Espoo (FI)

(72) Inventors: Tuomo Aho, Tampere (FI); Juha Pousi, Inkeroinen (FI)

(73) Assignee: Valmet Technologies Oy, Espoo (FI)

( * ) Notice: Subject to any disclaimer, the term of this patent is extended or adjusted under 35 U.S.C. 154(b) by 16 days.

(21) Appl. No.: 18/688,987

(22) PCT Filed: Nov. 24, 2022

(86) PCT No.: PCT/FI2022/050783

§ 371 (c)(1),
(2) Date: Mar. 4, 2024

(87) PCT Pub. No.: WO2023/099812

PCT Pub. Date: Jun. 8, 2023

(65) Prior Publication Data

US 2024/0410111 A1 Dec. 12, 2024

(30) Foreign Application Priority Data

Nov. 30, 2021 (FI) ..... 20216221

(51) Int. Cl.
*D21D 5/02* (2006.01)
*D21D 1/00* (2006.01)

(52) U.S. Cl.
CPC ..... *D21D 5/02* (2013.01); *D21D 1/00* (2013.01)

(58) Field of Classification Search
CPC ..... D21D 5/02
USPC ..... 162/4
See application file for complete search history.

(56) References Cited

U.S. PATENT DOCUMENTS 3,736,223 A * 5/1973 Marsh ..... B03B 9/06 241/DIG. 38
2008/0289149 A1* 11/2008 Chute ..... D01B 1/14 19/24
2022/0235519 A1 7/2022 Herchl et al.

FOREIGN PATENT DOCUMENTS

EP 2692945 A1 2/2014
EP 3511140 A1 7/2019
EP 3748074 A1 12/2020
WO 2022195168 A1 9/2022

OTHER PUBLICATIONS

International Search Report for PCT/FI2022/050783 dated Feb. 20, 2023.
Written Opinion of the International Searching Authority for PCT/FI2022/050783 dated Feb. 20, 2023.

* cited by examiner

*Primary Examiner* — Jacob T Minskey
(74) *Attorney, Agent, or Firm* — Stiennon & Stiennon

(57) ABSTRACT

Textile fibers of different lengths are fractionated in a liquid medium at a predetermined consistency into at least two fractions on the grounds of the fiber length, the two fractions being a first accept and a second accept. The second accept, which has longer fibers than the first accept, is led to a refining step in the liquid medium, and the refined fibers are fractionated in the liquid medium into at least two fractions on the grounds of the fiber length.

11 Claims, 1 Drawing Sheet

Short

METHOD FOR TREATING TEXTILE FIBERS OF DIFFERENT LENGTHS

CROSS REFERENCES TO RELATED APPLICATIONS

This application is a US national phase of PCT/FI2022/050783 filed on Nov. 24, 2022, and claims priority on Finnish App. No. FI 20216221, filed Nov. 30, 2021, both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for treating textile fibers of different lengths.

Recycled textile fibers typically have a wide length distribution. A pulp of the recycled textile fibers comprises fibers of different lengths and different raw materials. Long fibers in the pulp disturb further processing of the pulp. Further, it is difficult to separate synthetic fibers from the pulp.

SUMMARY OF THE INVENTION

An object of the present invention is to provide a method so as to overcome the above problems.

A term "short fibers" is used in this text. The short fibers mean that they are fibers that have lengths that are determined to belong to a short fiber fraction. The fiber lengths in the short fiber fraction may vary depending on the targeted end use. Further, there may be more than one short fiber fraction, each having its own fiber length distribution. The short fiber fractions may be used to the same or different end use. The short fiber fraction may be named alternatively as a first accept.

The average fiber length of the short fiber fraction may be from 30% to 80%, preferably from 40% to 70% and more preferably from 50% to 60% of the initial average fiber length of the feed material.

A term "long fibers" is used in this text. The long fibers mean that they are fibers that have lengths that are determined to belong to a long fiber fraction and they are longer than the short fibers. Further, there may be more than one long fiber fraction, each having its own fiber length distribution. The long fiber fraction may be named alternatively as a second accept.

The terms "refine" or "refining" are used in this text. The terms mean that fibers are cut or their surface is fibrillated in order to obtain shorter fibers.

A term "flotation" is used in this text. The term means a method for separating certain fibers from each other, i.e. short fibers may be separated from long fibers, or man-made fibers, e.g., synthetic fibers, may be separated from natural fibers.

A term "disperse" is used in this text. When fibers are dispersed it means that they are spread in a liquid medium. Further, possible flocs may break up.

The average fiber length of the long fiber fraction may be above 105%, preferably above 110% and more preferably above 120% of the initial average fiber length of the feed material.

The fiber length of the feed, the short and long fiber fractions can be analyzed and measured with a Valmet FS5 fiber analyzer or other similar apparatus. The technique of the Valmet FS5 fiber analyzer is based on optical measurements, i.e. the device scans bypassing fiber material and calculates fiber lengths by using certain algorithms.

The invention is based on the idea of using short fibers obtained from a recycled textile pulp in high-quality new products.

An advantage of the method is that the short fiber fraction can be separated efficiently and the desired fiber length can be achieved with low energy consumption. Also a desired fiber length distribution can be achieved by the method. In addition to the above-mentioned advantages, further processing steps, such as flotation, can be ensured since there is an even fiber mass advancing further in the process. The fiber mass has an even fiber length distribution and therefore, it is easier to separate fibers into certain fractions.

The primary idea behind the method in question is to recover short fibers from the recycled textile fiber pulp by fractionating the pulp into at least two fractions. The fractions that comprise long fibers are refined into short fibers in order to obtain short fibers for further processing. Further, only those fractions are refined that require it.

The recycled textile fiber pulp may comprise post-industrial waste, such as left-over pieces of fabrics or clothes and other textiles that are returned from retailers' stocks, or post-consumer textile waste. The major part may be recyclable clothes that people have discarded. The raw materials in the recycled textile fiber pulp may be shredded before they are processed by the current method.

The recycled textile fibers may comprise fibers of different lengths and different raw materials but natural wood fibers, e.g., mechanical pulp, are excluded. The recycled textile fibers may comprise natural fibers and/or man-made fibers. The natural fibers comprise e.g., cotton, flax, hemp, wool and silk. The man-made fibers may comprise regenerated fibers and/or synthetic fibers. The regenerated fibers comprise e.g., viscose and acetate. The synthetic fibers comprise e.g., polyester, polyamide and elastane.

The recycled textile fibers may comprise staple fibers and/or filament fibers. The recycled textile fibers may have different lengths compared to their original lengths because they go through shredding in order to form the recycled textile fiber pulp. The original lengths of cotton fibers may be from 25 mm to 45 mm. The original lengths of the staple man-made textile fibers in yarns may be from 20 mm to 60 mm. Filaments are continuous, i.e. their length is infinite. A fiber that originally was a continuous filament may be in the recycled fiber pulp a fiber having a certain length, for example. However, the recycled textile fiber pulp comprises long fibers that makes further processing difficult.

The short fiber fractions may be used in manufacturing nonwovens or dry-formed papers, for example. The recycled short fiber fractions may be used with virgin fibers. Further, the short fiber fractions may be used in manufacturing dissolving pulp.

The long fiber fractions may be used for yarns, for example. The recycled long fiber fractions may be used with virgin fibers.

In addition to the above-mentioned uses of the short fiber fractions the method is useful in forming a pulp having a desired fiber length distribution. It is possible to use the method for fractionating natural fibers, such as cotton, in order to obtain the desired fiber length distribution. Such material may be used as microfibrillated cellulose (MFC).

The method for fractionating textile fibers of different lengths comprises fractionating fibers in a liquid medium at a predetermined consistency. The consistency means the dry solid content of a pulp in a liquid medium, i.e., there is a suspension that consists of the pulp and the liquid medium. Usually, the main component of the liquid medium is water. The predetermined fractionating consistency may have a range of 0.2 to 4.0%, preferably a range of 0.5 to 2.0% and more preferably a range of 0.8 to 1.2%. The consistency is defined as $C=100x/(x+y)$, where C is consistency in percentages, x is the mass of pulp, and y is the mass of the rest of the suspension.

The method comprises fractionating the fibers in the liquid medium into at least two fractions on the grounds of the fiber length. The fibers are sorted at least into short and long fibers, i.e. into two fractions, which may be named the first accept and the second accept, but it is also possible that the fibers are sorted into multiple fractions, each fraction having its own fiber length distribution. It is important that the fibers are fractionated first since there are fibers that are short and they do not require any further treatments regarding to the fiber length.

The fibers are sorted into the fractions by using slotted screen baskets or hole screen baskets. The slotted screen basket may have a slot width of 0.1 to 0.5 mm. The hole screen basket may have a hole diameter of 0.1 to 3.0 mm.

The method comprises leading at least one fraction comprising long fibers to a refining step. The long fibers are refined into shorter fibers in a refiner. The refiner may be a LC refiner (low consistency 3.5 to 5%) or a HC refiner (high consistency 25 to 40%).

The method comprises fractionating the refined fibers. The refined fibers are sorted into at least two fractions, each fraction having its own fiber length distribution. It is possible that long fibers cycle through the refining and fractionating steps more than once until the desired outcome is achieved. The fiber lengths in the fractions can be measured and the fractionation operating parameters, such as a flow ratio, a feed consistency and/or a rotational speed, can be adjusted according to a need. Based on adjustment of operating parameters the fiber distribution to the short and long fiber fractions can be affected.

BRIEF DESCRIPTION OF THE DRAWINGS

In the following the invention will be described in greater detail by means of preferred embodiments with reference to the attached drawings.

DESCRIPTION OF THE PREFERRED EMBODIMENTS

Figure 1:
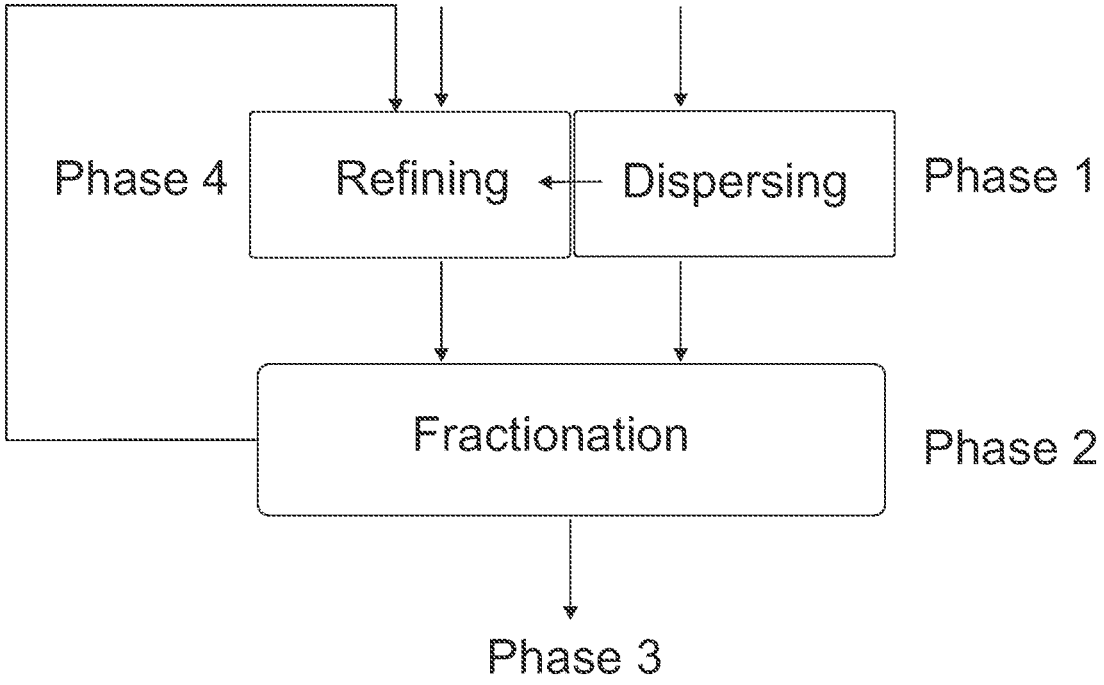
FIG. 1 shows a flow chart of the method.

FIG. 1 shows a flow chart of a method for fractionating textile fibers of different lengths. Recycled textile pulp may be dispersed in water in phase 1 in such a manner that the consistency is within 0.2 to 4%. After that the fibers may enter to a refining step, or to a fractionating step. Alternatively, the recycled textile fiber pulp may be fed directly to a refining step.

The recycled textile fiber pulp is fed into fractionation in phase 2 where the fibers of the pulp are fractionated into at least two fractions. The fraction comprising the short fibers, i.e. the first accept, may be led to further processing in phase 3. The further processing step may be e.g., flotation for separating the rest of the synthetic fibers from the fraction in question. The fraction of the short fibers may have fibers whose length is less than two millimeters. However, if there are more than two fractions more than one fraction may be led for further processing.

The fraction that has the long fibers, i.e. the second accept, is led for refining in phase 4. The fraction of the long fibers may have fibers whose length is at least two millimeters. The long fibers are refined in such a manner that their fiber length shortens. After the refining step the fibers return to the fractionating step at a consistency that is within 0.2 to 4%. The long fibers may cycle through the refining and fractionating steps as long as desired in order to achieve the desired fiber length.

Example

Table 1 shows a fiber distribution of a feed, i.e. a recycled textile fiber pulp that is fed into a fractionation process in order to produce a short fiber fraction and a long fiber fraction. Table 1 also shows a fiber distribution of the short fiber fraction and a fiber distribution of the long fiber fraction.

TABLE 1

| Feed (mm) | Distribution of the feed (%) | Short fiber fraction (mm) | Distribution of the short fiber fraction (%) | Long fiber fraction (mm) | Distribution of the long fiber fraction (%) |
|---|---|---|---|---|---|
| 0.00-0.20 | 16.7 | 0.00-0.20 | 28.3 | 0.00-0.20 | 13.1 |
| 0.20-0.60 | 19.9 | 0.20-0.60 | 28.2 | 0.20-0.60 | 19.1 |
| 0.60-1.20 | 22.8 | 0.60-1.20 | 24.0 | 0.60-1.20 | 23.0 |
| 1.20-2.00 | 19.4 | 1.20-2.00 | 13.7 | 1.20-2.00 | 20.3 |
| 2.00-3.20 | 13.3 | 2.00-3.20 | 5.2 | 2.00-3.20 | 15.3 |
| 3.20- | 7.9 | 3.20- | 0.7 | 3.20- | 9.2 |
| $L_c$ (l) (mm) | | $L_c$ (l) (mm) | | $L_c$ (l) (mm) | |
| 1.386 | | 0.832 | | 1.476 | |

The fiber length of the feed, short fiber and long fiber fractions can be analyzed and measured with the Valmet FS5 fiber analyzer or other similar apparatus. The fraction whose fiber length is 3.20 or more contains the longest fibers, i.e. the fraction may contain textile fibers whose length correspond to the original lengths of the textile fibers mentioned earlier in this text. The feed in this example was fibers that originate from recycled clothes and comprise both cotton and synthetic fibers.

Figure 2:
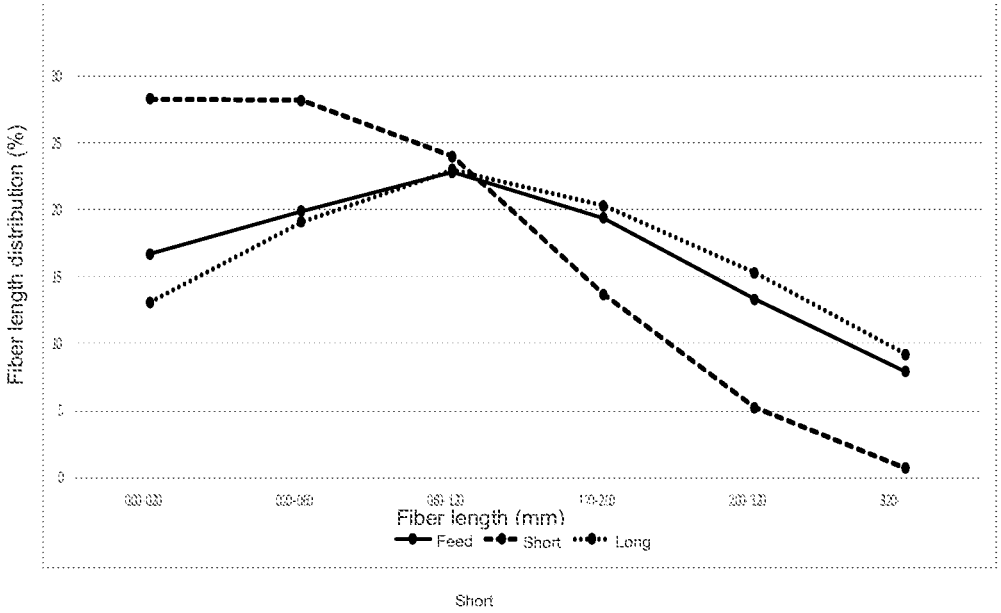
FIG. 2 shows fiber distributions of one trial.

FIG. 2 shows the results of table 1 graphically. One can see clearly that the recycled textile fiber pulp can be sorted efficiently into the short fiber fraction and the long fiber fraction. In other words, compared to the initial feed, i.e. the recycled textile fiber pulp, the fiber length of the short fiber fraction is weighted to the shorter fibers and the fiber length of the longer fiber fraction is weighted to the longer fibers.

As one can see from Table 1, there is only a minimum amount of fibers of length 3.20 mm or more in the short fiber fraction.

Synthetic material is also separated efficiently from the short fiber fraction. It was noticed that the recycled textile fiber pulp initially included 8.0 wt.-% of synthetic fibers. After the fractionation and refining process the short fiber fraction had 2.6 wt.-% of synthetic fibers and the long fiber fraction had 10.3 wt-% of synthetic fibers.

It will be obvious to a person skilled in the art that, as the technology advances, the inventive concept can be implemented in various ways. The invention and its embodiments are not limited to the examples described above but may vary within the scope of the claims.

The invention claimed is:

1. A method for treating an input feed comprised of textile fibers of different lengths, the textile fibers comprising natural fibers and man-made fibers comprising synthetic fibers of a first fractional amount, the method comprising:

in a fractionation phase fractionating the fibers in a liquid medium at a consistency of 0.2 to 4% into at least two fractions on the grounds of the fiber length, the two fractions being a first accept comprising natural fibers and synthetic fibers of a second fractional amount which is less than the first fractional amount and a second accept comprising synthetic fibers of a third fractional amount that is greater than the second fractional amount;

leading the first accept fraction away from the fractionation phase to further processing;

leading the second accept, which has longer fibers than the first accept, to a refining step in the liquid medium and refining the second accept into a refined feed; and returning the refined feed to the fractionation phase and fractionating the refined feed having fibers in the liquid medium at a consistency of 0.2 to 4% into at least two fractions on the grounds of the fiber length and returning the longer fiber fraction to the refining step and leading the shorter fiber fraction to further processing.

2. The method of claim 1, wherein the fibers in the fractionation phase are fractionated in the liquid medium at a consistency of 0.5 to 2%.

3. The method of claim 1 wherein the fibers in the fractionation phase are fractionated in the liquid medium at a consistency of 0.8 to 1.2%.

4. The method of claim 1 wherein the fractionating steps in the fractionation phase are carried out with a slotted screen basket or a hole screen basket.

5. The method of claim 1 wherein the further processing comprises a flotation step for separating synthetic fibers.

6. The method of claim 1 wherein the textile fibers treated in the process are derived from a recycled textile fiber pulp.

7. The method of claim 1 further comprising dispersing the textile fibers in the liquid medium prior to the fractionation phase.

8. The method of claim 1 wherein the input feed is fractionated in the fractionation phase into the first accept and the second accept before the input feed undergoes any refining step.

9. A method for treating textile fibers of different lengths, the textile fibers in an input feed comprising natural fibers and man-made fibers comprising synthetic fibers at a first fractional level wherein natural wood fibers are excluded, the method comprising:

in a first phase fractionating the fibers in a liquid medium at a consistency of 0.2 to 4% into at least two fractions on the grounds of the fiber length, the two fractions being a first accept and a second accept, wherein the second accept has longer fibers than the first accept and synthetic fibers at a second fractional level which is greater than the first fractional level, and wherein the liquid medium comprises water;

leading the second accept to a refining step in the liquid medium to produce refined fibers in a refined feed, wherein the refining step is carried out in an LC refiner or an HC refiner, and leading the first accept out of the first phase to further processing without going to the refining step; and leading the refined feed to the first phase such that the second accept returns to the refining step and the first accept is lead to further processing without returning to the refining step.

10. The method of claim 9 wherein the further processing comprises leading the first accept to a flotation step.

11. The method of claim 9 further comprising analyzing the fiber length of the feed, short fiber and long fiber fractions with a fiber analyzer and adjusting operating parameters of the first phase fractionation selected from the group consisting of a flow ratio, a feed consistency and a rotational speed to affect the fiber distribution of the short and long fiber fractions.

* * * * *